US009424964B1

(12) United States Patent
Kithuka et al.

(10) Patent No.: US 9,424,964 B1
(45) Date of Patent: Aug. 23, 2016

(54) SHIELDS CONTAINING MICROCUTS FOR USE IN COMMUNICATIONS CABLES

(71) Applicant: Superior Essex International LP, Atlanta, GA (US)

(72) Inventors: Jones M. Kithuka, Acworth, GA (US); Bernhart A. Gebs, Powder Springs, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 14/271,800

(22) Filed: May 7, 2014

Related U.S. Application Data

(60) Provisional application No. 61/820,905, filed on May 8, 2013.

(51) Int. Cl.
*H01B 11/08* (2006.01)

(52) U.S. Cl.
CPC ..... *H01B 11/08* (2013.01)

(58) Field of Classification Search
CPC ..... H01B 11/04; H01B 11/06; H01B 11/08; H01B 11/10
USPC ..... 174/113 R, 102 SP
See application file for complete search history.

(56) References Cited

U.S. PATENT DOCUMENTS

| | | | |
|---|---|---|---|
| 2,796,463 | A | 6/1957 | Mallinkrodt |
| 3,090,825 | A | 5/1963 | Volk |
| 3,135,935 | A | 6/1964 | Eugelbrecht |
| 3,312,774 | A | 4/1967 | Drinko |
| 3,373,475 | A | 3/1968 | Peterson |
| 4,129,841 | A | 12/1978 | Hildebrand et al. |
| 4,327,246 | A | 4/1982 | Kincaid |
| 4,604,497 | A | 8/1986 | Bell et al. |
| 4,638,272 | A | 1/1987 | Ive |
| 4,746,767 | A | 5/1988 | Gruhn |
| 4,881,642 | A | 11/1989 | Adam |
| 4,912,283 | A | 3/1990 | O'Connor |
| 5,006,806 | A | 4/1991 | Rippingale |
| 5,008,489 | A | 4/1991 | Weeks et al. |
| 5,106,175 | A | 4/1992 | Davis et al. |
| 5,114,517 | A | 5/1992 | Rippingale et al. |

(Continued)

FOREIGN PATENT DOCUMENTS

| | | |
|---|---|---|
| GB | 2432963 | 6/2007 |
| JP | 200090748 | 3/2000 |

(Continued)

OTHER PUBLICATIONS

First Office Action for U.S. Appl. No. 13/827,359, mailed on Aug. 7, 2014.

(Continued)

*Primary Examiner* — Chau N Nguyen

(57) ABSTRACT

Shielding elements for use in communication cables are described. A shielding element may include a dielectric material, and electrically conductive material may be formed on the dielectric material. Additionally, a plurality of microcuts may be formed in the electrically conductive material, for example, with one or more lasers. The plurality of microcuts may be spaced apart from one another such that electrically conductive material between the plurality of microcuts will fuse together if an electrical current is applied to the shielding element.

18 Claims, 8 Drawing Sheets

(56) References Cited

U.S. PATENT DOCUMENTS

| | | | | |
|---|---|---|---|---|
| 5,473,336 | A | 12/1995 | Harman et al. | |
| 5,952,615 | A | 9/1999 | Prudhon | |
| 5,956,445 | A | 9/1999 | Deitz et al. | |
| 6,207,901 | B1 | 3/2001 | Smith et al. | |
| 6,506,976 | B1 | 1/2003 | Neveux | |
| 6,677,518 | B2 * | 1/2004 | Hirakawa et al. | 174/36 |
| 6,687,437 | B1 | 2/2004 | Starnes et al. | |
| 6,723,925 | B2 | 4/2004 | Ohara et al. | |
| 6,737,574 | B2 | 5/2004 | Sylvia et al. | |
| 6,770,819 | B2 | 8/2004 | Patel | |
| 6,831,231 | B2 * | 12/2004 | Perelman et al. | 174/102 R |
| 6,850,161 | B1 | 2/2005 | Elliott et al. | |
| 6,888,070 | B1 | 5/2005 | Prescott | |
| 7,173,189 | B1 | 2/2007 | Hazy et al. | |
| 7,179,999 | B2 | 2/2007 | Clark et al. | |
| 7,208,683 | B2 | 4/2007 | Clark | |
| 7,332,676 | B2 | 2/2008 | Sparrowhawk | |
| 7,335,837 | B2 | 2/2008 | Pfeiler et al. | |
| 7,600,723 | B2 | 10/2009 | Borchers | |
| 7,834,270 | B2 | 11/2010 | Zhu et al. | |
| 7,923,632 | B2 | 4/2011 | Smith et al. | |
| 7,923,641 | B2 * | 4/2011 | Smith | H01B 11/1008 174/113 R |
| 8,119,906 | B1 | 2/2012 | Smith et al. | |
| 8,445,787 | B2 | 5/2013 | Nordin et al. | |
| 8,558,115 | B2 | 10/2013 | Jenner et al. | |
| 2006/0048961 | A1 | 3/2006 | Pfeiler et al. | |
| 2007/0037419 | A1 | 2/2007 | Sparrowhawk | |
| 2007/0224495 | A1 | 9/2007 | Gibbons et al. | |
| 2007/0275583 | A1 | 11/2007 | McNutt et al. | |
| 2008/0255435 | A1 | 10/2008 | Al-Ali et al. | |
| 2008/0314636 | A1 | 12/2008 | Ogura | |
| 2009/0200060 | A1 | 8/2009 | Smith et al. | |
| 2009/0223694 | A1 | 9/2009 | Nordin et al. | |
| 2009/0272571 | A1 | 11/2009 | Gromko | |
| 2010/0096179 | A1 | 4/2010 | Sparrowhawk et al. | |
| 2010/0101853 | A1 | 4/2010 | McNutt et al. | |
| 2010/0224389 | A1 * | 9/2010 | Jenner et al. | 174/113 R |
| 2011/0147039 | A1 | 6/2011 | Smith et al. | |
| 2016/0037691 | A1 | 2/2016 | Kroushl et al. | |

FOREIGN PATENT DOCUMENTS

| | | |
|---|---|---|
| JP | 2006173044 | 6/2006 |
| WO | WO2006105166 | 5/2006 |

OTHER PUBLICATIONS

Non-Final Rejection for U.S. Appl. No. 13/827,257, mailed on Jan. 14, 2015.

Non-Final Rejection for U.S. Appl. No. 13/835,800, mailed on Feb. 19, 2015.

Final Office Action mailed on Mar. 3, 2015 for U S. Appl. No. 13/827,359.

"Product Catalogue" 2 pages, Enterprise cabling R&M, May 2006.

"Draka" 12 pages, Draka Comteq, Cable Solutions, Data Cables, Sep. 27, 2006.

"10 Gigabit Ethernet Solutions" 8 pages, R&M Convincing Cabling Solutions.

Wetzikon, "R&M: The Rising Stars in Copper Cabling" 2 pages, Sep. 1, 2005.

"R&M Star Real 10" 2 pages, Mar. 2006.

"Connections 29" 36 pages, Sep. 2005.

Pfeiler et al., U.S. Pat. No. 7,335,837, issued Feb. 26, 2008.

Notice of Allowance and Fee(s) Due in U.S Appl. No. 14/578,921, mailed on Oct. 9, 2015.

Notice of Allowance and Fee(s) Due in U.S. Appl. No. 13/827,359, mailed on Oct. 2, 2015.

Office Action, mailed Jul. 9, 2015, in the U.S. Appl. No. 13/835,800.

Notice of Allowance and Fee(s) Due in U.S. Appl. No. 13/835,800, mailed on Mar. 15, 2016.

* cited by examiner

SHIELDS CONTAINING MICROCUTS FOR USE IN COMMUNICATIONS CABLES

CROSS-REFERENCE TO RELATED APPLICATION

This application claims priority to U.S. Provisional Application No. 61/820,905, filed May 8, 2013 and entitled "Micro Cut Multi-Segmented Shield Tape," the contents of which is incorporated by reference herein in its entirety.

TECHNICAL FIELD

Embodiments of the disclosure relate generally to shielding elements for use in communication cables and, more particularly, to segmented or discontinuous shielding elements that contain a plurality of microcuts.

BACKGROUND

As the desire for enhanced communication bandwidth escalates, transmission media need to convey information at higher speeds while maintaining signal fidelity and avoiding crosstalk, including alien crosstalk. However, effects such as noise, interference, crosstalk, alien crosstalk, and/or alien equal-level far-end crosstalk ("ELFEXT") can strengthen with increased data rates, thereby degrading signal quality or integrity. For example, when two cables are disposed adjacent one another, data transmission in one cable can induce signal problems in the other cable via crosstalk interference.

One approach to addressing crosstalk between communication cables is to circumferentially encase one or more conductors in a continuous shield, such as a flexible metallic tube or a foil that coaxially surrounds the cable's conductors. However, shielding based on conventional technology can be expensive to manufacture and/or cumbersome to install in the field. In particular, complications can arise when a shield is electrically continuous between the two ends of the cable. The continuous shield can inadvertently carry voltage along the cable, for example from one terminal device at one end of the cable towards another terminal device at the other end of the cable. If a person contacts the shielding, the person may receive a shock if the shielding is not properly grounded. Accordingly, continuous cable shields are typically required to be grounded at both ends of the cable to reduce shock hazards and loop currents that can interfere with transmitted signals. Such a continuous shield can also set up standing waves of electromagnetic energy based on signals received from nearby energy sources. In this scenario, the shield's standing wave can radiate electromagnetic energy, somewhat like an antenna, that may interfere with wireless communication devices or other sensitive equipment operating nearby.

In order to address the limitations of continuous shields, segmented or discontinuous shields have been incorporated into certain cables. These segmented shields typically include metallic patches formed on a polymeric film, and electrical discontinuity (i.e., spaces or gaps) is maintained between the metallic patches. Thus, the patches function as an electromagnetic shield; however, it is not necessary to ground the shields during cable installation. In current segmented shield designs, the spaces or gaps between metallic patches may lead to electrical perturbations and decreased performance in the cable. In particular, electromagnetic signals may leak or pass between the metallic patches via the spaces or gaps. Additionally, the width and spacing of gaps in current shield designs typically allows signals at critical wavelengths to leak and cause noise during electrical transmission. Accordingly, there is an opportunity for improved segmented shields, methods or techniques for forming segmented shields, and/or cables incorporating segmented shields.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
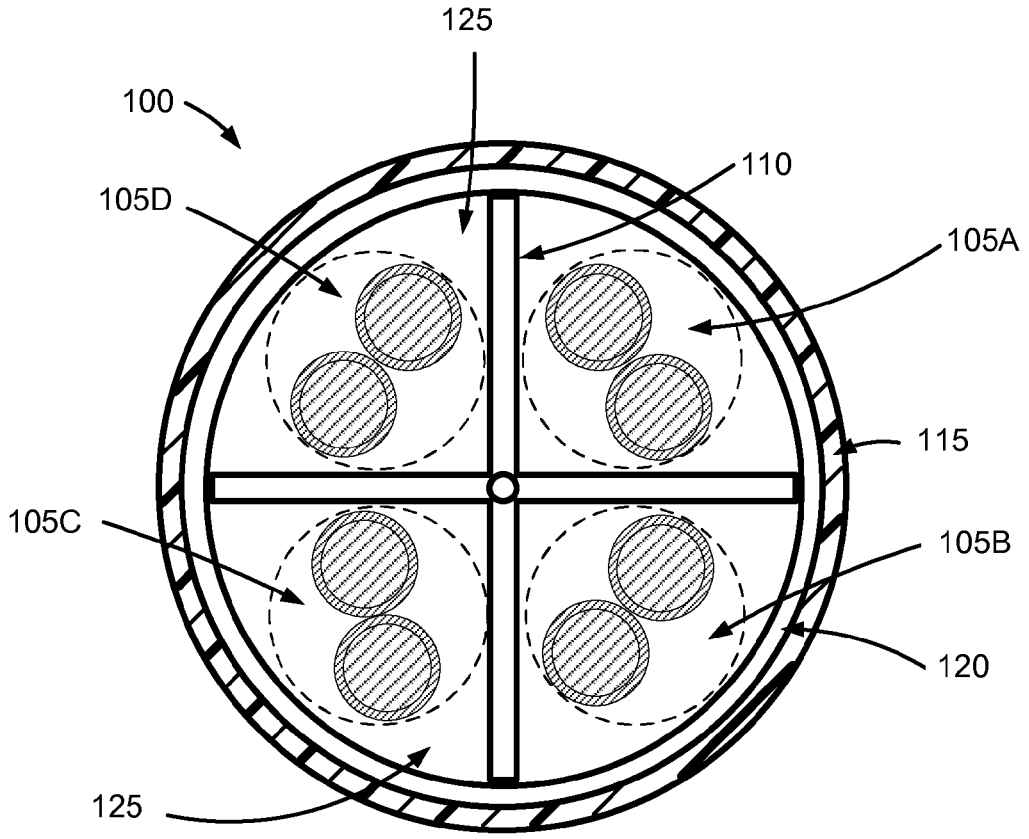
FIGS. 1-3 are cross-sectional views of example cables that each include at least one discontinuous shielding element formed with microcuts, according to an illustrative embodiment of the disclosure.

Various embodiments of the present disclosure are directed to shields for use in cables, such as twisted pair communication cables and/or other cables that incorporate electrical conductors. In accordance with various example embodiments, a cable may include one or more transmission media within a core of the cable, such as one or more twisted pairs of conductors. Additionally, one or more suitable shielding elements may be incorporated into the cable in order to provide electromagnetic shielding for one or more of the transmission media. For example, individual twisted pair shields, shields for groups of twisted pairs, overall shields, and/or shielding separators or fillers may be incorporated into the cable. According to an aspect of the disclosure, at least one shielding element may be a discontinuous shielding element having a plurality of separate sections or patches of electrically conductive material.

Additionally, at least one of the sections or patches of electrically conductive material on a shielding element may be defined by, incorporate, and/or include a plurality of microcuts formed through (or partially through) the electrically conductive material. For example, one or more lasers may be utilized to form a series of relatively narrow and/or small microcuts in the electrically conductive material incorporated into a shield. In certain embodiments, the width of each of these microcuts may be less than or equal to approximately 0.25 mm. These relatively narrow microcuts may limit the leakage of the shielding element, and therefore, reduce noise during electrical transmission using the cable.

In certain embodiments, a series of microcuts may be placed in relatively close proximity to one another. For example, a series of microcuts may be formed as an alternative to a traditional space or gap between electrically conductive patches of material. As one example, a conventional discontinuous shield may include gaps or spaces between electrically conductive patches, and each gap or space may be at least approximately 0.050 inches (approximately 1.27 mm) wide. By contrast, in an example embodiment of the disclosure, a plurality of relatively narrow or fine microcuts (e.g., microcuts of approximately 0.25 mm, etc.) may be formed in an approximately 0.050 inch wide portion (or any other desired width) of a shielding element. Additionally, in certain embodiments, a plurality of sections or segments of microcuts may be formed in the shielding element, and each section may include a plurality of individual microcuts. Using the example above, a conventional shield may include 0.050 inch wide gaps spaced anywhere from a few centimeters to a few meters apart. Embodiments of the disclosure may space sections of microcuts anywhere from a few centimeters to a few meters apart (or any other desired spacing), and each section of microcuts may include a plurality of individual microcuts.

Although the examples above describe situations in which conventional spaces or gaps are respectively replaced with a series of microcuts, a wide variety of other suitable configurations of microcuts may be utilized as desired. For example, in certain embodiments, a shielding element may include microcuts continuously spaced in close proximity to one another along a longitudinal length of the shielding element. In other embodiments, sections or patches of microcuts may be spaced at regular intervals or in accordance with any desired pattern. Each section or patch may include at least two microcuts. In yet other embodiments, sections or patches of microcuts may be positioned in random locations along a shielding element.

Additionally, as explained in greater detail below, a wide variety of suitable patterns may be formed by microcuts. For example, a section of microcuts (e.g., one section of a repeating pattern, etc.) may include microcuts having a perpendicular line pattern, a dashed vertical line pattern, a square pattern, an inverse square pattern, a diamond-shaped pattern, an inverse diamond-shaped pattern, a checkerboard pattern, an angled line pattern, a curved line pattern, or any other desired pattern. As another example, a section of microcuts may include microcuts that form one or more alphanumeric characters, graphics, and/or logos. In this regard, product identification information, manufacturer identification information, safety instructions, and/or other desired information may be displayed on a shielding element.

In certain embodiments, the utilization of shielding elements that include a plurality of microcuts may exhibit improved electrical performance relative to conventional shields. The shielding elements with microcuts may provide for reduced or limited leakage, provide for reduced noise, and/or provide for reduced crosstalk relative to conventional shields. Additionally, it is noted that the use of singular microcuts at spaced intervals may allow electricity to arc across the microcuts, thereby leading to a safety hazard. In other words, electricity may arc across isolated narrow microcuts along a shielding element. However, a plurality of microcuts positioned or formed in relatively close proximity to one another may limit safety risks due to electrical arcing. Any electrical arcing across the microcut gaps will likely burn up or destroy the electrically conductive material between the closely spaced microcuts, thereby breaking or severing the electrical continuity of the shielding element and preventing current from propagating down the shielding element. In other words, the microcuts may be spaced and/or formed to result in a shield that includes electrically conductive material having a sufficiently low mass such that the electrically conductive material will fuse or melt when current is applied to the shielding element.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIG. 1, a cross-section of an example cable 100 that may be utilized in various embodiments is illustrated. The cable 100 is illustrated as a communications cable; however, other types of cables may be utilized. The cable 100 may include a wide variety of suitable transmission media, such as one or more twisted pairs, one or more optical fibers, one or more coaxial cables, one or more power conductors, one or more electrical conductors, etc. As illustrated in FIG. 1, the cable 100 may include a plurality of twisted pairs of electrical conductors 105A-D. In other embodiments, the cable 100 may include a combination of twisted pairs and one or more other types of transmission media (e.g., optical fibers, etc.). Additionally, embodiments of the disclosure may be utilized in association with horizontal cables, vertical cables, flexible cables, equipment cords, cross-connect cords, plenum cables, riser cables, or any other appropriate types of cables.

According to an aspect of the disclosure, the cable 100 may also include one or more shielding elements. Shielding elements may include, for example, shield layers wrapped around or enclosing one or more of the twisted pairs 105A-D and/or a separation filler 110 incorporating shielding material and positioned between one or more twisted pairs. As explained in greater detail below, at least one of the shielding elements may include electrically conductive material with a plurality of microcuts formed at least partially through the electrically conductive material, for example, series of microcuts positioned between adjacent patches or sections of electrically conductive material. Additionally, an outer jacket 115 may be formed around the twisted pairs 105A-D and one or more shielding elements.

Figure 2:
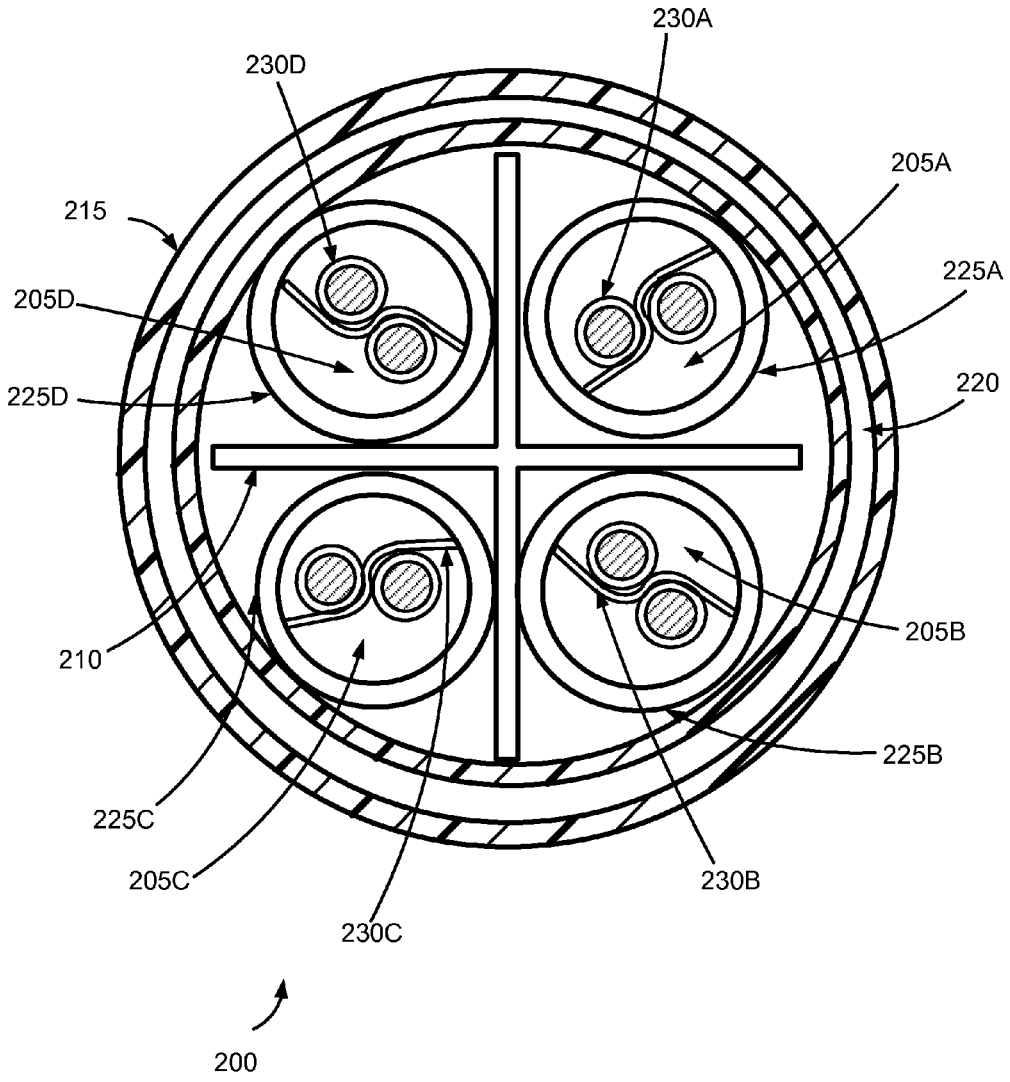
Figure 3:
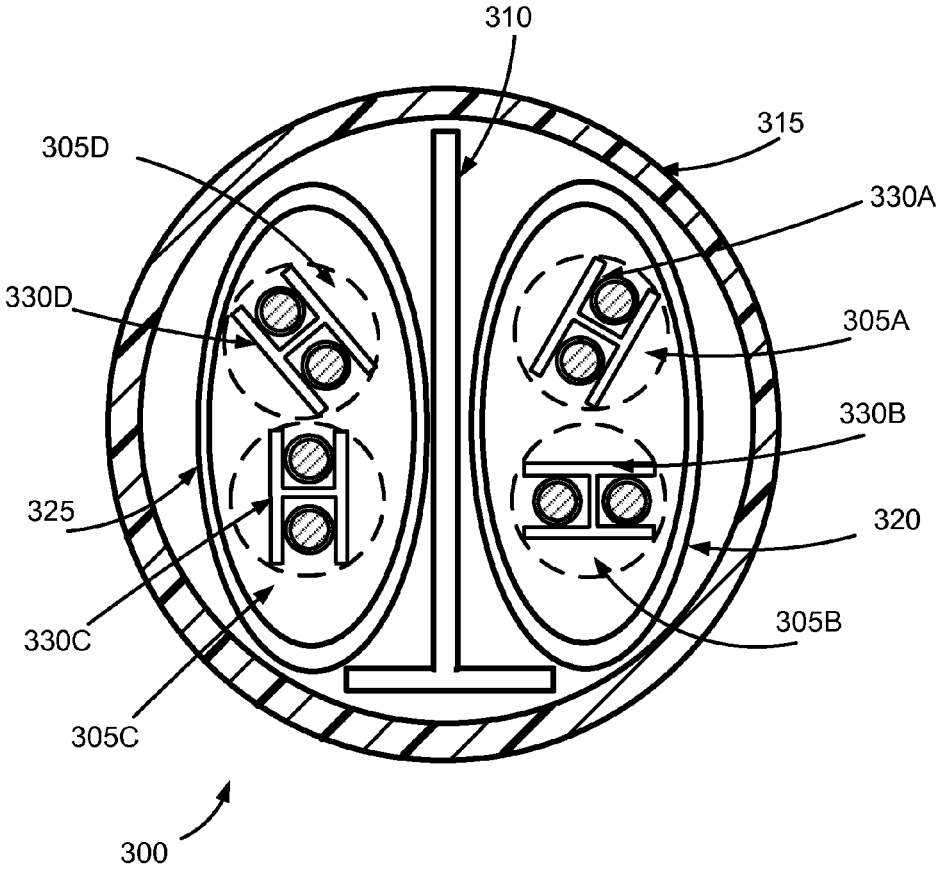

In certain embodiments, one or more shield layers can be disposed between the jacket 115 and one or more additional cable components. For example, an external shield 120 or an overall shield may be disposed between the jacket 115 and the twisted pairs 105. As another example, as illustrated in FIG. 2, individual shields may be provided for each of the twisted pairs. As yet another example, as illustrated in FIG. 3, shield layers may be provided for any desired groupings of twisted pairs. In other embodiments, a shield layer (or shielding material) may be incorporated into or embedded into the jacket 115 or placed on the outside of the jacket 115. In certain embodiments, one or more shield layers may incorporate electrically conductive material in order to provide electrical shielding for one or more cable components. Further, in certain embodiments, the cable 100 may include a separate, armor layer (e.g., a corrugated armor, etc.) for providing mechanical protection.

A shield layer, such as an external shield 120 or an individual twisted pair shield, may be formed from a wide variety of suitable materials and/or utilizing a wide variety of suitable techniques. In certain embodiments, a shield layer may be formed with a plurality of layers. For example, electrically conductive material may be formed on a dielectric substrate to form a shield layer. As desired, the electrically conductive material may include discrete patches of material, thereby resulting in a discontinuous shield. These discrete patches may be formed by positioning microcuts at desired positions within the electrically conductive materials. In other embodiments, a shield layer may include relatively continuous electrically conductive material, and microcuts may be formed partially through the electrically conductive material. As a result, discrete patches are not provided on the shield layer, however, the shield may function as a discontinuous shield from a safety perspective. In other embodiments, a shield layer may include semi-conductive material. Additionally, in certain embodiments, a shield layer may be formed as a continuous shield layer along a longitudinal length of the cable 100. In other embodiments, a shield layer may include a plurality of separate segments or components along a longitudinal length of the cable 100. As desired, one or more adjacent shield layer components may overlap one another along shared longitudinal edges. Alternatively, spaces or gaps may be present between certain shield layer components.

Any number of twisted pairs may be utilized as desired in the cable 100. As shown in FIG. 1, the cable 100 may include four twisted pairs 105A, 105B, 105C, 105D. As desired, the twisted pairs 105A-D may be twisted or bundled together and/or suitable bindings may be wrapped around the twisted pairs 105A-D. In other embodiments, multiple grouping of twisted pairs may be incorporated into a cable. As desired, each grouping may be twisted, bundled, and/or bound together. Further, in certain embodiments, the multiple groupings may be twisted, bundled, or bound together.

Each twisted pair (referred to generally as twisted pair 105 or collectively as twisted pairs 105) may include two electrical conductors, each covered with suitable insulation. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. As desired, the differences between twist rates of twisted pairs 105 that are circumferentially adjacent one another (for example the twisted pair 105A and the twisted pair 105B) may be greater than the differences between twist rates of twisted pairs 105 that are diagonal from one another (for example the twisted pair 105A and the twisted pair 105C). As a result of having similar twist rates, the twisted pairs that are diagonally disposed can be more susceptible to crosstalk issues than the twisted pairs 105 that are circumferentially adjacent; however, the distance between the diagonally disposed pairs may limit the crosstalk. Thus, the different twist lengths and arrangements of the pairs can help reduce crosstalk among the twisted pairs 105. Additionally, in certain embodiments, each of the twisted pairs 105A-D may be twisted in the same direction (e.g., clockwise, counter clockwise). In other embodiments, at least two of the twisted pairs 105A-D may be twisted in opposite directions.

The electrical conductors may be formed from any suitable electrically conductive material, such as copper, aluminum, silver, annealed copper, gold, or a conductive alloy. Additionally, the electrical conductors may have any suitable diameter, gauge, and/or other dimensions. Further, each of the electrical conductors may be formed as either a solid conductor or as a conductor that includes a plurality of conductive strands that are twisted together.

The insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

Each twisted pair 105 can carry data or some other form of information, for example in a range of about one to ten Giga bits per second ("Gbps") or another appropriate frequency, whether faster or slower. In certain embodiments, each twisted pair 105 supports data transmission of about two and one-half Gbps (e.g. nominally two and one-half Gbps), with the cable 100 supporting about ten Gbps (e.g. nominally ten Gbps). In certain embodiments, each twisted pair 105 supports data transmission of up to about ten Gbps (e.g. nominally ten Gbps), with the cable 100 supporting about forty Gbps (e.g. nominally forty Gbps).

The jacket 115 may enclose the internal components of the cable 100, seal the cable 100 from the environment, and provide strength and structural support. The jacket 115 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 115 may be formed as a single layer or, alternatively, as multiple layers. In certain embodiments, the jacket 115 may be formed from one or more layers of foamed material. As desired, the jacket 115 can include flame retardant and/or smoke suppressant materials. Additionally, the jacket 115 may include a wide variety of suitable shapes and/or dimensions. For example, the jacket 115 may be formed to result in a round cable or a cable having an approximately circular cross-section; however, the jacket 115 and internal components may be formed to result in other desired shapes, such as an elliptical, oval, or rectangular shape. The jacket 115 may also have a wide variety of dimensions, such as any suitable or desirable outer diameter and/or any suitable or desirable wall thickness. In various embodiments, the jacket 115 can be characterized as an outer jacket, an outer sheath, a casing, a circumferential cover, or a shell.

An opening enclosed by the jacket 115 may be referred to as a cable core, and the twisted pairs 105A-D may be disposed within the cable core. Although a single cable core is illustrated in the cable 100 of FIG. 1, a cable may be formed to include multiple cable cores. In certain embodiments, the cable core may be filled with a gas such as air (as illustrated) or alternatively a gelatinous, solid, powder, moisture absorbing material, water-swellable substance, dry filling compound, or foam material, for example in interstitial spaces between the twisted pairs 105A-D. Other elements can be added to the cable core as desired, for example one or more optical fibers, additional electrical conductors, additional twisted pairs, water absorbing materials, and/or strength members, depending upon application goals.

In certain embodiments, the cable 100 may also include a separator 110 or filler configured to orient and or position one or more of the twisted pairs 105A-D. The orientation of the twisted pairs 105A-D relative to one another may provide beneficial signal performance. As desired in various embodiments, the separator 110 may be formed in accordance with a wide variety of suitable dimensions, shapes, or designs. For example, a rod-shaped separator, a flat tape separator, a flat separator, an X-shaped or cross-shaped separator, a T-shaped separator, a Y-shaped separator, a J-shaped separator, an L-shaped separator, a diamond-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized. In certain embodiments, material may be cast or molded into a desired shape to form the separator 110. In other embodiments, a tape may be formed into a desired shape utilizing a wide variety of folding and/or shaping techniques. For example, a relatively flat tape separator may be formed into an X-shape or cross-shape as a result of being passed through one or more dies.

In certain embodiments, the separator 110 may be continuous along a length of the cable 100. In other embodiments, the separator 110 may be non-continuous or discontinuous along a length of the cable 100. In other words, the separator 110 may be separated, segmented, or severed in a longitudinal direction such that discrete sections or portions of the separator 110 are arranged longitudinally (e.g., end to end) along a length of the cable 100. Use of a non-continuous or segmented separator may enhance the flexibility of the cable 100, reduce an amount of material incorporated into the cable 100, and/or reduce the cable cost.

In the event that a discontinuous separator 110 is utilized, the various portions or segments of the separator 110 may include a wide variety of different lengths and/or sizes as desired. Additionally, in certain embodiments, each of the separator segments or portions may have lengths that are approximately equal. In other embodiments, various portions of the separator 110 may have varying lengths. These varying lengths may follow an established pattern or, alternatively, may be incorporated into the cable 100 at random. In certain embodiments, gaps or spaces may be present in the longitudinal direction of the cable 100 between two consecutive or adjacent portions of the separator 110. In other embodiments, adjacent portions of the separator 110 may be permitted to contact one another. In the event that adjacent portions are permitted to contact one another, relatively consistent and predictable stiffness (and in certain embodiments shielding) may be provided along a length of a cable; however, the discontinuity of the separator 110 may allow greater flexibility. In yet other embodiments, gaps may be present between some adjacent portions of the separator 110 while other adjacent portions are permitted to contact one another. In certain embodiments, the sizes of gaps or spaces between consecutive portions of the separator 110 may be approximately equal along a length of the cable 100. In other embodiments, the sizes of the gaps may be varied in accordance with a pattern or in a random manner. Additionally, a wide variety of suitable gap sizes may be utilized as desired in various embodiments. In certain embodiments, the gaps may be small enough to prevent the twisted pairs 105A-D from contacting each other in the interstitial spaces between portions of the separator 110.

The separator 110 may be formed from a wide variety of suitable materials as desired in various embodiments. For example, the separator 110 and/or various separator segments can include paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, the separator 110 may be filled, unfilled, foamed, un-foamed, homogeneous, or inhomogeneous and may or may not include additives (e.g., flame retardant and/or smoke suppressant materials).

In certain embodiments, electrically conductive material may be incorporated into a separator 110. For example, a separator 110 may include electrically conductive material, such as one or more electrically conductive patches (e.g., metallic patches, etc.) formed on or adhered to a dielectric substrate or base. As another example, a separator 110 may include electrically conductive material embedded into or impregnated into a dielectric material. As yet another example, a separator 110 may include relatively solid sections of electrically conductive material, such as discrete electrically conductive segments incorporated into a segmented separator or electrically conductive sections incorporated into a continuous separator (or various separator segments of a discontinuous separator). As a result of incorporating electrically conductive material, the separator 110 may function as a shielding element. Additionally, in certain embodiments and as described in greater detail below, microcuts may be formed or positioned in the electrically conductive material of the separator 110.

In certain embodiments, each segment or portion of the separator 110 may be formed from similar materials. In other embodiments, a separator 110 may make use of alternating materials in adjacent portions (whether or not a gap is formed between adjacent portions). For example, a first portion or segment of the separator 110 may be formed from a first set of one or more materials, and a second portion or segment of the separator 110 may be formed from a second set of one or more materials. As one example, a relatively flexible material may be utilized in every other portion of a separator 110. As another example, relatively expensive flame retardant material may be selectively incorporated into desired portions of a separator 110. In this regard, material costs may be reduced while still providing adequate flame retardant qualities.

As set forth above, a wide variety of different types of shielding elements (e.g., shield layers, separators that include shielding material, etc.) and/or combinations of shielding elements may be incorporated into a cable 100. These shielding elements may utilize a wide variety of different materials and/or have a wide variety of suitable configurations. For example, a wide variety of suitable electrically conductive materials or combinations of materials may be utilized in a shielding element including, but not limited to, metallic material (e.g., silver, copper, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C., such as an electrical resistivity of less than approximately $3\times10^{-8}$ ohm meters at approximately 20° C. In the event that discontinuous patches or sections of electrically conductive material are utilized, the patches may have any desired dimensions, such as any desired lengths and/or thicknesses. Further, any desired gaps, spaces, and/or arrangements of microcuts may be positioned between adjacent patches. Further, electrically conductive material incorporated into a shield element may have a wide variety of suitable arrangements and/or shapes.

As desired, a wide variety of suitable techniques and/or processes may be utilized to form a shield element. For example, a separator 110 may be formed by extruding, poltruding, or otherwise forming a base dielectric layer, and electrically conductive material may then be applied or adhered to the base material. As desired, a base layer in a separator 110 may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer. Additionally, as desired, the base layer may be hollow to provide a cavity that may be filled with air or some other gas, gel, fluid, moisture absorbent, water-swellable substance, dry filling compound, powder, one or more optical fibers, one or more metallic conductor (e.g., a drain wire, etc.), shielding, or some other appropriate material or element.

In certain embodiments, a shielding element, such as a shield layer (e.g., an external shield layer 120, an individual twisted pair shield, etc.) or separator 110, may be formed as a tape that includes both a dielectric layer (e.g., plastic, polyester, polyethylene, polypropylene, fluorinated ethylene propylene, polytetrafluoroethylene, polyimide, or some other polymer or dielectric material that does not ordinarily conduct electricity, etc.) and an electrically conductive layer (e.g., copper, aluminum, silver, an alloy, etc.). As one example, a separate dielectric layer and electrically conductive layer may be bonded, adhered, or otherwise joined (e.g., glued, etc.) together to form the shielding element. In the event that an adhesive is utilized, a wide variety of suitable adhesives can be used. In certain embodiments, one or more additives may be used with and/or incorporated into the adhesive to color, absorb laser light (i.e., laser light at desired frequencies and/or ranges of frequencies, etc.), and/or to absorb energy from a given electromagnetic spectrum. In other embodiments, similar types of additives may be incorporated into a dielectric layer of a shield. The use of one or more suitable additives may assist in the formation of microcuts via one or more lasers. In other embodiments, electrically conductive material may be formed on a dielectric layer via any number of suitable techniques, such as the application of metallic ink or paint, liquid metal deposition, vapor deposition, welding, heat fusion, adherence of patches to the dielectric, etc. In certain embodiments, the conductive patches can be over-coated with an electrically insulating film, such as a polyester coating. Additionally, in certain embodiments, an electrically conductive layer may be sandwiched between two dielectric layers. In other embodiments, at least two electrically conductive layers may be combined with any number of suitable dielectric layers to form the shielding element. Indeed, any number of suitable layers of material may be utilized to form a tape which may be used as a shielding element.

As set forth above, a shielding element may include any number of patches of electrically conductive material. In certain embodiments, at least one shielding element may be a discontinuous shielding element having a plurality of separate sections or patches of electrically conductive material. The electrical isolation may result from gaps or spaces between electrically conductive patches, such as gaps of dielectric material and/or air gaps (e.g., gaps between adjacent separator segments, etc.). The respective physical separations between the patches may impede the flow of electricity between adjacent patches. As desired, the separations between certain patches may be accomplished by a plurality of microcuts formed through the electrically conductive material. In other embodiments, microcuts may be formed partially through the electrically conductive material.

A wide variety of suitable techniques and/or methods may be utilized to form microcuts in the electrically conductive material of a shielding element. In certain embodiments, following the formation of electrically conductive material may on a dielectric material, a plurality of microcuts may be formed in the electrically conductive material utilizing one or more lasers. Laser microcutting may be performed at any suitable point in time during the manufacture of a shielding element and/or during the construction of a cable 100. For example, laser microcutting may be performed on a shielding element in an in-line process during the construction of a cable (e.g., during cable assembly prior to the jacketing of the cable) and incorporation of the shielding element into the cable. As another example, laser microcutting may be performed on a shielding element in an off-line process prior to the completed shielding element being incorporated into a cable 100.

Additionally, in certain embodiments, laser microcutting may be electronically controlled. For example, a suitable computing system including one or more suitable computing devices (e.g., personal computers, server computers, microcontrollers, minicomputers, etc.) may control the one or more lasers to achieve desired microcutting. Each computing device may include one or more processors and memory devices. The memory devices may store data and computer-executable or computer-readable code (e.g., an operating system, a laser control program, etc.) accessible by the processor(s), and execution of the computer-executable code may form a special purpose machine configured to control the laser microcutting.

The use of lasers may permit the formation of a wide variety of precise microcuts in a shielding element. For example, laser microcutting may permit the formation of a plurality of microcuts in relatively close proximity to one another. In other words, laser microcutting may permit the formation of multiple narrowly spaced microcuts and associated patches of electrically conductive material. Additionally, laser microcutting may permit easier formation of electrically conductive segments having varying lengths and/or varying angles. The use of laser microcutting may additionally be easier to implement inline during cable formation relative to conventional cutting techniques.

Although the use of lasers is described above as an example technique for forming microcuts, a wide variety of other techniques may be utilized. For example, microcuts may be formed by relatively precise chemical etching or via precise cutting with one or more suitable blades or cutting tools. Indeed, any suitable technique capable of forming relatively precise microcuts, such as microcuts having a width of approximately 0.25 mm or less, may be utilized. By contrast, conventional discontinuous shields include metallic patches that are separated by much larger gaps or spaces, such as gaps that are typically greater than approximately 0.05 inches (1.27 mm) wide. Additionally, current techniques for forming discontinuous shields are likely incapable of forming relatively precise microcuts. For example, many conventional shields are formed by using a relatively large knife to cut away metallic material. Typically, conventional cutting is performed offsite prior to a shield being shipped to a cable manufacturing facility. These conventional cutting techniques make it difficult to manufacture shielding elements having varying lengths of electromagnetic patches or segments, to manufacture shielding having varying segment angles, and/or to manufacture a plurality of narrowly spaced segments. Additionally, it is often difficult to implement conventional cutting techniques inline during cable construction.

A wide variety of suitable configurations of microcuts may be utilized as desired for a shielding element. These configurations may include any number of microcuts. Additionally, the microcuts may be formed at a wide variety of desired angles and/or in a wide variety of desired patterns. According to an aspect of the disclosure, each of the microcuts may be relatively narrow or have a relatively small width. For example, each microcut may have a width between approximately 0.025 mm and approximately 0.25 mm. In certain embodiments, each microcut may have a width that is less than or equal to approximately 0.25 mm. These relatively narrow microcuts may limit the leakage of electromagnetic signals through a shielding element, and therefore, reduce noise during electrical transmission using the cable.

In certain embodiments, one or more microcuts may be formed through the electrically conductive material. For example, microcuts may completely remove electrically conductive material from a dielectric portion of a shielding element. In other embodiments, one or more microcuts may be formed partially through electrically conductive material. For example, microcuts may be formed sufficiently through the electrically conductive material such that the electrically conductive material in a section or segment of microcuts will fuse or melt when a current is applied to a shielding element. In certain embodiments, microcuts may be formed approximately 40%, 50%, 60%, 70%, 80%, 90%, 95%, or any other suitable value included in a range of one or more of the previous percentages. In yet other embodiments, a portion of the microcuts in a shielding element may be formed through the electrically conductive material while another portion of the microcuts are formed partially through the electrically conductive material.

In certain embodiments, a shielding element may include microcuts continuously spaced in relatively close proximity to one another along a longitudinal length of the shielding element. In other embodiments, a plurality of microcuts may be placed in relatively close proximity to one another on a shielding element to form a series or grouping of microcuts. In this regard, one or more series or sections of microcuts may be formed in a shielding element. As desired, sections or patches of microcuts may be spaced at regular intervals or in accordance with any desired pattern. In other embodiments, sections or patches of microcuts may be positioned at random locations along a shielding element.

By forming a continuously spaced microcuts or sections that include a plurality of microcuts, safety characteristics for the shielding element may be enhanced. If individual or singular microcuts are formed or positioned at spaced intervals on a shielding element, electricity may arc across the microcuts, thereby leading to a safety hazard in which electricity may be propagated along the shielding element. As such, the shielding element will likely either need to be grounded or include a drain. However, the formation of a plurality of microcuts positioned or formed in relatively close proximity to one another may exhibit improved electrical performance while limiting safety risks. Any electrical arcing across the microcut gaps will likely burn up the electrically conductive material between the closely spaced microcuts, thereby breaking or severing the electrical continuity of the shielding element and preventing current from propagating down the shielding element. In other words, the microcuts may be spaced and/or formed to result in a shield that includes electrically conductive material having a sufficiently low mass such that the electrically conductive material will fuse or melt when a suitable current and/or associated voltage is applied to the shielding element. For example, the electrically conductive material will fuse or melt when a current and a voltage is applied. When the fusable link formed by the microcuts and associated electrically conductive material is destroyed, electrical energy cannot travel down the shielding element. As a result, the risk of electrical shock and property damage may be substantially reduced.

Additionally, for microcuts placed in relatively close proximity to one another, the electrically conductive material positioned between adjacent microcuts and/or near adjacent microcuts may have a wide variety of suitable dimensions. In certain embodiments, the electrically conductive material may be sized such that it will fuse or melt in the event that current is applied to the shielding element. For example, the width and/or length of electrically conductive material positioned between adjacent microcuts may be between approximately 0.025 mm and approximately 25 mm. As another example, the width of electrically conductive material may be between approximately 0.25 mm and approximately 25 mm. As yet another example, the width and/or length of electrically conductive material positioned between adjacent microcuts may be less than or equal to approximately 25 mm. In other embodiments, wider sections of electrically conductive material may be utilized.

Each section or series of microcuts may include any number of microcuts formed in relatively close proximity to one another. Accordingly, each series or section of microcuts may have any suitable dimensions. For example, a section of microcuts may have an overall length along a longitudinal direction of the shielding element of approximately 1.0, 5.0, 10, 20, 30, 40, 50, 60, 70, 80, 90, 100 millimeters, a value in a range between any two of these values, and/or a value greater than approximately 1000 millimeters. In certain embodiments, microcut sections may have lengths less than or equal to approximately 51 mm. Other series or section lengths may be utilized as desired. Additionally, within a particular section, the individual microcuts may be formed at any suitable angle(s) (e.g., an angle between approximately zero degrees and 180 degrees, etc.) relative to the longitudinal direction of the shielding element.

In certain embodiments, a plurality of microcut sections may be formed as an alternative to the spaces or gaps formed between electrically conductive patches in conventional shields. As one example, a conventional discontinuous shield may include gaps or spaces between electrically conductive patches, and each gap or space may be greater than or equal to approximately 0.050 inches along a longitudinal length of the shield. By contrast, in an example embodiment of the disclosure, a plurality of sections of relatively fine microcuts may be formed, and each section may be approximately 0.050 inches (or any other desired distance) in length along a longitudinal length of the shield. Thus, the conventional gaps or spaces may be replaced with sections of microcuts. As a result, the shielding element may exhibit improved electrical performance.

The electrically conductive patches of a shielding element may include a wide variety of suitable dimensions, for example, any suitable lengths in the longitudinal direction and/or any suitable thicknesses. Additionally, sections of microcuts formed between electrically conductive patches (e.g., larger patches relative to the electrically conductive material formed between adjacent microcuts in a section of microcuts) may have any suitable widths and/or other dimensions. Additionally, a plurality of electrically conductive patches may be formed in accordance with a pattern or in random fashion. As desired, the dimensions can be selected to provide electromagnetic shielding over a specific band of electromagnetic frequencies or above or below a designated frequency threshold. In certain embodiments, each patch may have a length of about one meter to about ten meters or greater (e.g., a length of up to 100 meters, etc.), although lengths of less than one meter (e.g., lengths of about 1.5 to about 2 inches, etc.) may be utilized. For example, the patches may have a length in a range of about one to ten meters and isolation spaces in a range of about one to five millimeters. In various embodiments, the patches may have a length of about 0.03, 0.05, 0.1, 0.3, 0.5, 0.75, 1.0, 1.5, 2.0, 2.5, 3.0, 3.5, 4.0, 4.5, or 5.0 meters or in a range between any two of these values.

As set forth above, microcut sections formed between adjacent patches, may have any suitable lengths along a longitudinal direction of a shielding element. Additionally, a wide variety of distances may be utilized as desired between adjacent microcut sections or segments, such as distances between a few centimeters to meters in length. In certain embodiments, these distances may be approximately equal to the lengths of electrically conductive patches. Thus, it will be appreciated that these distances include any of the values set forth above for the example lengths of electrically conductive patches. Additionally, in certain embodiments, the patches of electrically conductive material may be formed as first patches (e.g., first patches on a first side of a dielectric material), and second patches may be formed on an opposite side of the dielectric material (or on another dielectric material). For example, second patches may be formed to correspond with microcut segments between the first patches.

In certain embodiments, a dielectric portion of a tape (e.g., a tape that is formed into a desired shape to form a separator 110, a tape used to form a shield layer, etc.) may have a thickness of about 1 to about 5 mils (thousandths of an inch) or about 25 to about 125 microns. In the event that a non-tape separator is utilized, a dielectric portion or base portion of the separator may have any suitable dimensions, such as any suitable thickness, diameter, or circumference. The electrically conductive material may include a coating of metal having any desired thickness, such as a thickness of about 0.5 mils (about 13 microns) or greater. In many applications, signal performance benefits from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. Indeed, with a thickness of less than about 1.5 mils, negative insertion loss characteristics may be present on the cable 100. A wide variety of other configurations including different thicknesses will also be appreciated.

In certain embodiments, the electrically conductive patches incorporated into a shielding element may have a spiral direction that is opposite the twist direction of the pairs 105A-D. For example, the cable core and the four twisted pairs 105A-D may be collectively twisted about a longitudinal axis of the cable 100 in a common direction. The twist direction of the pairs 105A-D may be opposite the spiral direction of the patches. That is, if the core is twisted in a clockwise direction, then the patches may spiral in a counterclockwise direction. If the core is twisted in a counterclockwise direction, then the conductive patches may spiral in a clockwise direction. Thus, cable lay opposes the direction of the patch spiral. The opposite directions may provide an enhanced level of shielding performance. In other embodiments, the patches may have a spiral direction that is the same as the twist direction of the pairs 105A-D. Additionally, in certain embodiments, electrically conductive patches and/or microcuts may be formed at an angle relative to a longitudinal direction of a shielding element. Accordingly, when the shielding element is incorporated into the cable 100 (e.g., wrapped around one or more twisted pairs), the patches will be positioned in a spiral direction. In other embodiments, a shield layer may be wrapped around one or more twisted pairs at any suitable angle to result in patches having a spiral direction. In yet other embodiments, patches may be formed at a suitable first angle, and a shield layer may be wrapped around one or more twisted pairs at a suitable second angle (which may be the same as or different from the first angle).

Additionally, as desired in various embodiments, a wide variety of suitable patterns may be formed by the microcuts and/or patches of electrically conductive material. In certain embodiments, a pattern of microcuts may be formed along a longitudinal length of a shielding element. In other embodiments, various sections of microcuts may include desired patterns. In certain embodiments, a given pattern may be utilized for each of the microcut sections incorporated into a shielding element. In other embodiments, different patterns may be utilized for different microcut sections. In other words, any number of microcut patterns may be incorporated into a shielding element. Examples of suitable microcut patterns (e.g., patterns that may be utilized in a microcut section or along a length of a shielding element, etc.) include, but are not limited to, a perpendicular line pattern (e.g. a perpendicular line pattern formed across a width dimension of a shielding element or formed transverse to a longitudinal direction of the shielding element, a perpendicular line pattern formed at any desired angle, etc.), a dashed perpendicular line pattern, a square pattern, an inverse square pattern, a diamond-shaped pattern, an inverse diamond-shaped pattern, a checkerboard pattern, an angled line pattern, a pattern of one or more curved lines, or any other desired pattern. In certain embodiments, one or more sections of microcuts may include microcuts that form one or more alphanumeric characters, graphics, and/or logos. In this regard, product identification information, manufacturer identification information, safety instructions, and/or other desired information may be displayed on a shielding element. A wide variety of other patterns and/or arrangements may be utilized as desired. Additionally, a few non-limiting examples of microcut patterns are described in greater detail below with reference to FIGS. 6A-6N.

In certain embodiments and as illustrated in FIG. 1, both a separator 110 and an external shield 120 may be incorporated into a cable. For example, a separator 110 may be positioned between a multitude of twisted pairs 105, and an external shield 120 may circumscribe the twisted pairs 105 (or a desired grouping of one or more twisted pairs). Further, both the separator 110 and the external shield 120 may include electrically conductive material. In this regard, the separator 110 may provide for shielding between the twisted pairs, and the external shield 120 may shield the twisted pairs from external signals. As a result of utilizing both a separator 110 and shield 120, the performance of the cable 100 may be similar to a cable in which each of the twisted pairs 105 is individually shielded (i.e., a shielded twisted pair ("STP") cable). In other words, the cable 100 utilizing both a separator and an external shield may function as an alternative to conventional STP cables. However, the cable 100 may be easier to terminate by a technician.

Additionally, in certain embodiments, at least one electrically conductive patch included in a shielding element, such as shield 120 (or another suitable shield), may be electrically shorted or continuous along a circumferential direction. In other words, when the shield 120 is wrapped around one or more twisted pairs 105A-D, an electrically conductive patch may contact itself, for example, at the edges of the shield. As a result, the patch may be electrically shorted to itself, thereby creating a continuous patch in a circumferential direction or along a periphery of the enclosed twisted pairs 105A-D. As a result, electrical perturbations caused by the shield may be reduced relative to conventional cables. Therefore, the cable 100 may exhibit improved electrical performance, such as reduced return loss and/or reduced crosstalk loss.

A wide variety of suitable techniques may be utilized as desired to short patches in a circumferential direction. For example, a shield may be folded over itself along one edge (e.g., an edge in the width direction) or along one or more portions of one edge (e.g., portions of an edge corresponding to electrically conductive patches). Accordingly, when the shield is wrapped around one or more twisted pairs (and/or other cable components) and brought into contact with itself within an overlapping region, the patch material at one edge of the shield will be brought into contact with the patch material at or near the opposing edge of the shield. As another example, an overhanging portion be formed in which electrically conductive patch material extends beyond the dielectric material at one edge or at portions of one edge of a shield. As another example, one or more vias and/or spaces may be formed through the dielectric material to permit patches to be circumferentially shorted. As yet another example, patches may be formed around one edge (or along portions of one edge) of the dielectric material.

A wide variety of other materials may be incorporated into the cable 100 as desired. For example, in certain embodiments, a respective dielectric separator or demarcator (not shown in FIG. 1) may be positioned between the individual conductive elements or electrical conductors of one or more of the twisted pairs 105. FIGS. 2 and 3 illustrate example cables 200, 300 that includes dielectric separators between the conductive elements of various twisted pairs. In certain embodiments, a dielectric separator may be provided for each of the twisted pairs 105 of a cable 100. In other embodiments, only a portion of the twisted pairs 105 may include a dielectric separator positioned between the individual conductors. In yet other embodiments, no dielectric separators may be provided.

In certain embodiments, a dielectric separator may be woven helically between the individual conductors or conductive elements of a twisted pair 105. In other words, the dielectric separator may be helically twisted with the conductors of the twisted pair 105 along a longitudinal length of the cable 100. In certain embodiments, the dielectric separator may maintain spacing between the individual conductors of the twisted pair 105 and/or maintain the positions of one or both of the individual conductors. For example, the dielectric separator may be formed with a cross-section (e.g., an X-shaped cross-section, an H-shaped cross-section, etc.) that assists in maintaining the position(s) of one or both the individual conductors of the twisted pair 105. In other words, the dielectric separator may reduce or limit the ability of one or both of the individual conductors to shift, slide, or otherwise move in the event that certain forces, such as compressive forces, are exerted on the cable 100. In other embodiments, a dielectric separator may be formed as a relatively simple film layer that is positioned between the individual conductors of a twisted pair 105.

Additionally, in certain embodiments, a dielectric separator may include one or more portions that extend beyond an outer circumference of a twisted pair 105. When the individual conductors of a twisted pair 105 are wrapped together, the resulting twisted pair 105 will occupy an approximately circular cross-section along a longitudinal length of the cable 100, although the cross-section of the twisted pair 105 is not circular at any given point along the longitudinal length. In certain embodiments, a dielectric separator may extend beyond the outer circumference formed by the twisted pair 105. In this regard, the dielectric separator may maintain a desired distance between the twisted pair 105 and a shield layer, such as shield layer 110. Thus, when the shield layer 110 is formed around the twisted pair 105, a circumference of the shield layer 110 will be greater than that of the twisted pair 105.

Other materials may be incorporated into a cable 100 as desired in other embodiments. For example, as set forth above, the cable 100 may include any number of conductors, twisted pairs, optical fibers, and/or other transmission media. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, and/or other materials.

The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1.

FIG. 2 is a cross-sectional view of another example cable 200 including at least one shielding element, according to an illustrative embodiment of the disclosure. The cable 200 of FIG. 2 may include components that are similar to the cable 100 illustrated and described above with reference to FIG. 1. Accordingly, the cable 200 may include a plurality of twisted pairs 205A-D disposed in a cable core. A separator 210 may be disposed between at least two of the twisted pairs 205A-D and may function to orient and/or provide desired spacing between two or more of the twisted pairs 205A-D. In some embodiments, the separator 210 may function as a shielding element.

With continued reference to FIG. 2, an outer jacket 215 may enclose the internal components of the cable 200. Additionally, a shield layer 220 may be incorporated into the outer jacket 215. In certain embodiments, the shield layer 220 may be sandwiched between two other layers of outer jacket material, such as two dielectric layers. The layers of jacket material that sandwich the shield layer 220 may be formed of similar materials or, alternatively, of different materials. Further, a wide variety of suitable techniques may be utilized to bond or adhere the shield layer 220 to the other layers of the jacket 215. In other embodiments, electrically conductive material may be injected or inserted into the outer jacket 215. In yet other embodiments, the outer jacket 215 may be impregnated with electrically conductive material. In yet other embodiments, the cable 200 may not include an outer shield layer 220.

Additionally, as desired in certain embodiments, each of the twisted pairs 205A-D may be individually shielded. For example, shield layers 225A-D may respectively be wrapped or otherwise formed around each of the twisted pairs 205A-D. In other words, a first shield layer 225A may be formed around a first twisted pair 205A, a second shield layer 225B may be formed around a second twisted pair 205B, a third shield layer 225C may be formed around a third twisted pair 205C, and a fourth shield layer 225D may be formed around a fourth twisted pair 205D. In other embodiments, a portion or none of the twisted pairs may be individually shielded. Indeed, a wide variety of different shielding arrangements may be utilized in accordance with various embodiments of the disclosure. Additionally, one or more of the shielding elements (e.g., individual pair shields, overall shield, separator, etc.) incorporated into the cable 200 may include a plurality of microcuts formed within the electrically conductive material.

Further, the cable 200 includes respective dielectric separators 230A-D positioned between the individual conductors of the respective twisted pairs 205A-D. The dielectric separators 230A-D are formed as dielectric films that may maintain separation between the conductors of the twisted pairs 205A-D. Additionally, in certain embodiments, the dielectric separators 230A-D may extend beyond an outer circumference of the twisted pairs, thereby maintaining a desired separation distance between the twisted pairs 205A-D and the individual pair shields 210A-D.

FIG. 3 is a cross-sectional view of another example cable 300 including at least one shield, according to an illustrative embodiment of the disclosure. The cable 300 of FIG. 3 may include components that are similar to the cable 100 illustrated and described above with reference to FIG. 1. Accordingly, the cable 300 may include a plurality of twisted pairs 305A-D disposed in a cable core. A separator 310 may be disposed between at least two of the twisted pairs 305A-D and may function to orient and/or provide desired spacing between two or more of the twisted pairs 305A-D. In some embodiments, the separator 310 may function as a shielding element.

The separator 310 illustrated in FIG. 3 has a different construction than the separators 110, 210 illustrated in FIGS. 1 and 2. In particular, the separator 310 is a generally T-shaped separator that approximately bisects (or otherwise divides) the cable core and forms two channels along a longitudinal length of the cable 300 in which the twisted pairs 305A-D are disposed. For example, two twisted pairs 305A, 305B can be disposed in a first channel and the remaining two twisted pairs 305C, 305D can be disposed in a second channel. The T-shaped separator 310 illustrated in FIG. 3 is merely one example of an alternative separator shape, and a wide variety of other separator shapes may be utilized as desired.

With continued reference to FIG. 3, an outer jacket 315 may enclose the internal components of the cable 300. Additionally, any number of shield layers may be utilized to provide shielding for the twisted pairs 305A-D. For example, a first shield layer 320 may be wrapped or otherwise formed around two of the twisted pairs, such as the twisted pairs 305A, 305B disposed in the first channel. A second shield layer 325 may be wrapped or otherwise formed around other twisted pairs, such as twisted pairs 305C, 305D disposed in the second channel. In other words, shield layers may be provided for various groups of twisted pairs disposed within the cable core. Additionally, one or more of the shielding elements (e.g., shield layers, separator, etc.) incorporated into the cable 300 may include a plurality of microcuts formed within the electrically conductive material.

Further, the cable 300 of FIG. 3 is illustrated as having dielectric separators 330A-D positioned between the individual conductors of the respective twisted pairs 305A-D. The dielectric separators 330A-D are illustrated as having approximately H-shaped cross-sections, although other suitable cross-sections may be utilized as desired. Each of the dielectric separators 330A-D may provide suitable channels in which the conductors of a twisted pair may be situated. As a result, the dielectric separators 330A-D may maintain the positions of the twisted pairs 305A-D when the cable 300 is subjected to various forces and stresses, such as compressive forces.

Similar to the cable 100 illustrated in FIG. 1, the cables 200, 300 illustrated in FIGS. 2-3 are provided by way of example only. Embodiments of the disclosure contemplate a wide variety of other cables and cable constructions. These other cables may include more or less components than the cables 200, 300 illustrated in FIGS. 2-3. For example, other cables may include alternative shielding arrangements and/or different types of separators or fillers. Other cables may also include alternative numbers and/or configurations of dielectric films. Additionally, certain components may have different dimensions and/or materials than the components illustrated in FIGS. 2-3.

Figure 4:
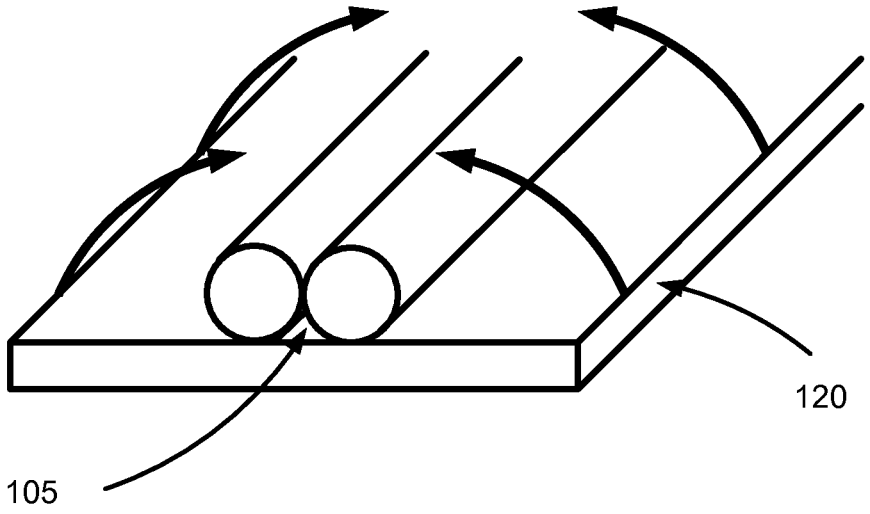
FIG. 4 illustrates an example technique for wrapping one or more twisted pairs with a shield layer in accordance with certain embodiments of the disclosure.

A wide variety of suitable techniques may be utilized as desired to wrap one or more twisted pairs with a shield layer. FIG. 4 illustrates one example technique for wrapping one or more twisted pairs, such as one or more of the twisted pairs 105 illustrated in FIG. 1, with a shield layer, such as the shield 120 illustrated in FIG. 1. With reference to FIG. 4, one or more twisted pairs 105 may be positioned adjacent to a shield layer 120, such as a segmented tape shield layer. The twisted pair(s) 105 may extend essentially parallel with the major or longitudinal axis/dimension of the shield layer 120. Thus, the twisted pair(s) can be viewed as being parallel to the surface or plane of the shield layer 120. As desired, the twisted pair(s) 105 may be approximately centered along a width dimension of the shield layer 120. Alternatively, the twisted pair(s) 105 may be positioned closer to one edge of the shield layer 120.

In certain applications, two conductors, which are typically individually insulated, will be twisted together to form a twisted pair 105. The shield layer 120 may then be wrapped around the twisted pair 105. Alternatively, the shield layer 120 may be wrapped around multiple twisted pairs of conductors, such as twisted pairs that have been twisted, bunched, or cabled together. During wrapping, one edge (or both edges) of the shield layer (e.g., the distal edge opposite the edge at which the twisted pair(s) is positioned) may be brought up over the twisted pair(s) 105, thereby encasing the twisted pair(s) 105 or wrapping the shield layer around or over the twisted pair(s) 105. In an example embodiment, the motion can be characterized as folding or curling the shield layer over the twisted pair(s) 105.

In certain embodiments, the shield layer 120 may be wrapped around the twisted pair(s) 105 without substantially spiraling the shield layer 120 around or about the twisted pair(s). Alternatively, the shield layer 120 may be wrapped so as to spiral around the twisted pair(s) 105. Additionally, in certain embodiments, the electrically conductive material may face away from the twisted pair(s) 105, towards the exterior of a cable. In other embodiments, the electrically conductive material may face inward, towards the twisted pair(s) 105. In yet other embodiments, electrically conductive material may be formed on both sides of the shield layer 120.

In one example embodiment, the shield layer 120 and the twisted pair(s) 105 are continuously fed from reels, bins, containers, or other bulk storage facilities into a narrowing chute or a funnel that curls the shield layer over the twisted pair(s). In certain embodiments, microcuts may be formed in the shield layer 120 prior to the shield layer being fed from one or more suitable supply sources into cabling equipment. In other embodiments, microcuts may be formed utilizing one or more suitable inline operations (e.g., one or more suitable lasers) as the shield layer 120 is fed or after the shield layer is fed from one or more suitable supply sources.

Additionally, in certain embodiments, a relatively continuous shield layer 120 may be incorporated into a cable. In other embodiments, a shield layer material (e.g., a tape, etc.) may be cut as it is incorporated (or prior to incorporation) into a cable so as to facilitate the formation of various types of shields having discontinuous segments. Downstream from the mechanism(s) (or as a component of this mechanism) that feed cable core components, a nozzle or outlet port can extrude a polymeric jacket, skin, casing, or sheath over the shield layer 120, thus providing the basic architecture depicted in FIG. 1 and discussed above.

Figure 5A:
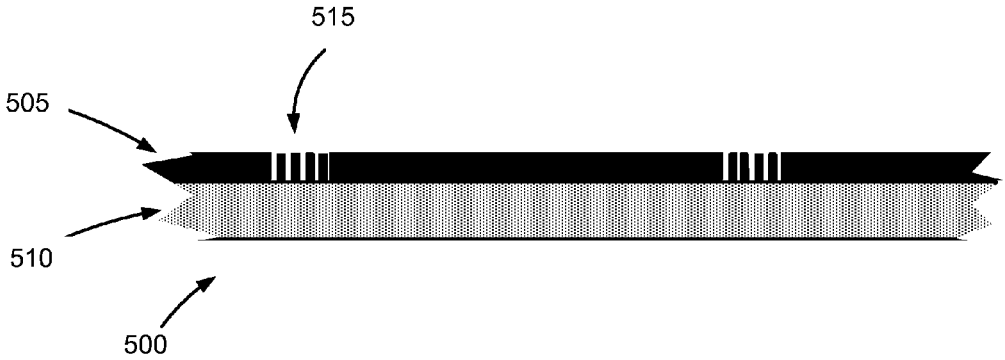
FIGS. 5A-5B illustrate cross-sections for example shielding elements that are formed with microcuts, in accordance with various embodiments of the disclosure.
Figure 5B:
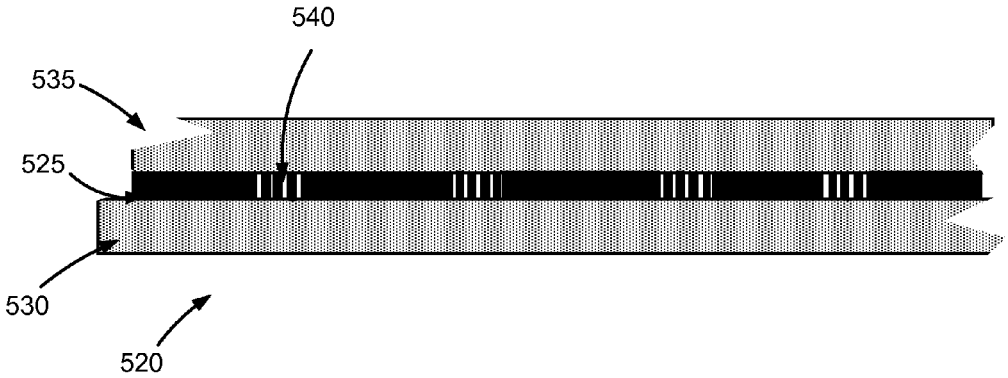

FIGS. 5A-5B illustrate cross-sections for example shielding elements that may be utilized in accordance with various embodiments of the disclosure. A shielding element, such as the shield 120 illustrated in FIG. 1, may have a cross-section similar to one of the example cross-sections illustrated in FIGS. 5A-5B. FIG. 5A illustrates a first example shielding element 500 that may be utilized in conjunction with one or more twisted pairs and/or other transmission media. In certain embodiments, the shielding element 500 may be formed as a tape or other configuration including a substrate or carrier layer with electrically conductive material formed on the substrate. The shielding element 500 may include a dielectric layer 510, and an electrically conductive layer 505 may be formed or disposed on one side of the dielectric layer 510. As desired in other embodiments, electrically conductive material may be formed on both sides of the dielectric layer 510. The electrically conductive layer 505 may include any number of patches of electrically conductive material and/or microcuts in order to form a discontinuous shield layer. As shown, microcuts 515 may be formed in sections or segments at desired locations along the shielding element 500. Additionally, the microcuts 515 are illustrated as being formed completed through the electrically conductive layer 505. However, in other embodiments, at least a portion of the microcuts 515 may be formed partially through the electrically conductive layer 505.

FIG. 5B illustrates another example shielding element 520 in which an electrically conductive layer 525 is sandwiched between two dielectric layers 530, 535. Microcuts 540 may be formed at least partially through the electrically conductive layer 525 at any desired locations along the shielding element 520. Additionally, it will be appreciated that a wide variety of other constructions may be utilized as desired to form a shielding element in accordance with various embodiments of the disclosure. Indeed, any number of dielectric and electrically conductive layers may be utilized. The shielding elements 500, 520 illustrated in FIGS. 5A-5B are provided by way of example only.

Figure 6A:
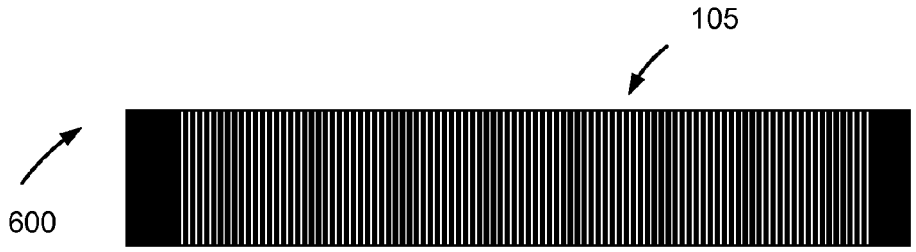
FIGS. 6A-6N illustrate example microcut configurations that may be utilized in association with shielding elements in various embodiments of the disclosure.
Figure 6B:
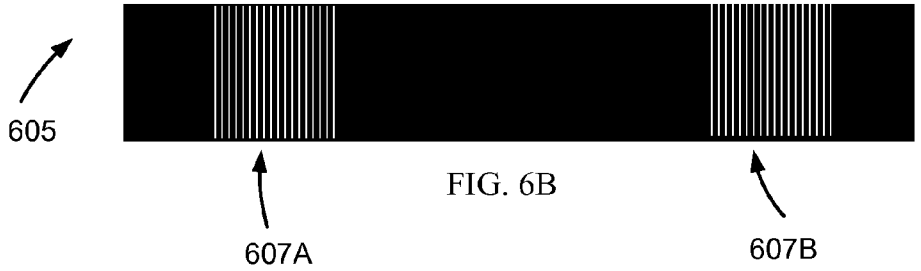
Figure 6C:
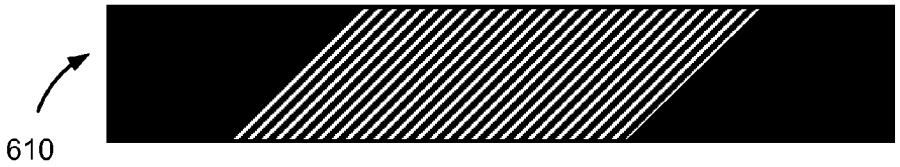
Figure 6D:
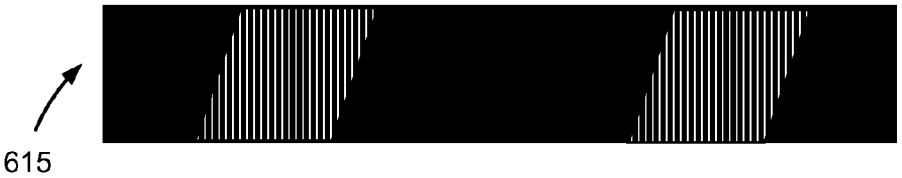
Figure 6E:
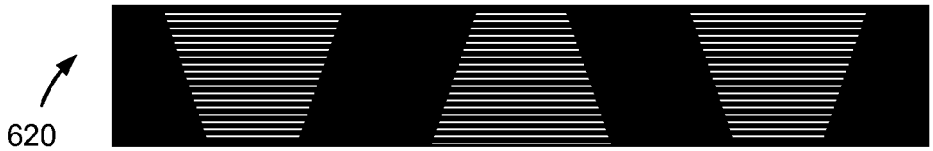
Figure 6F:
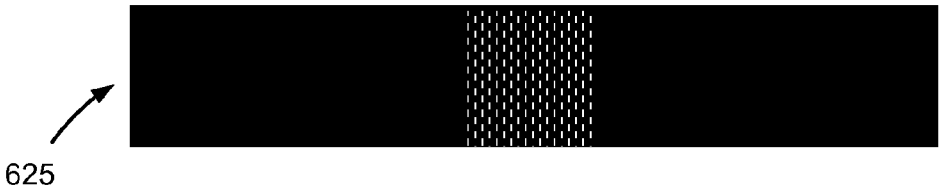
Figure 6G:
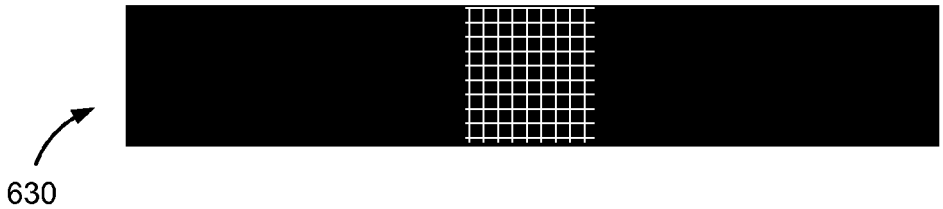
Figure 6H:
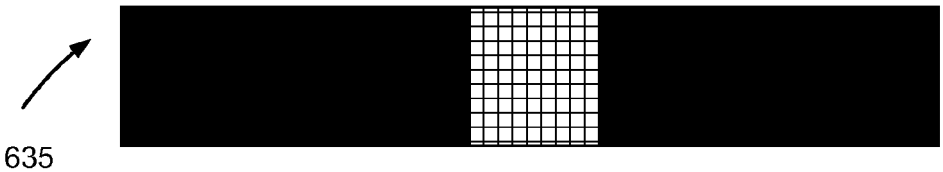
Figure 6I:
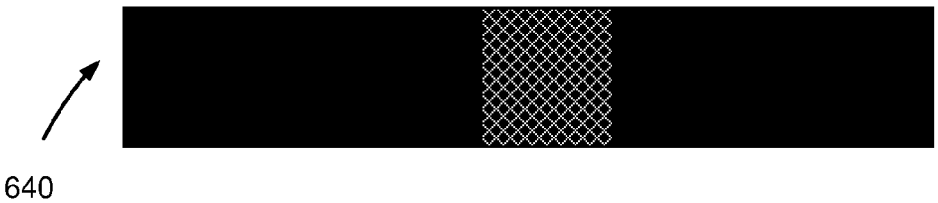
Figure 6J:
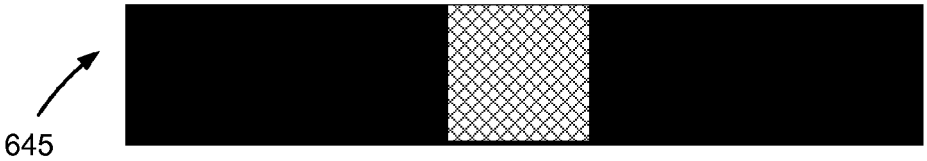
Figure 6K:
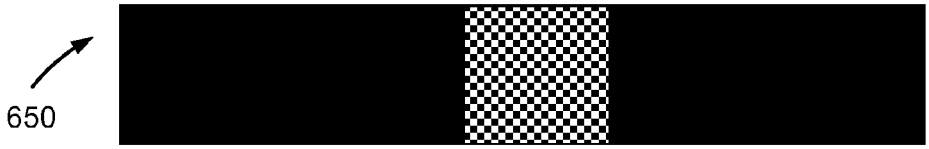
Figure 6L:
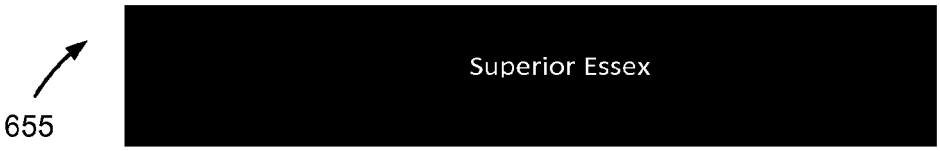
Figure 6M:
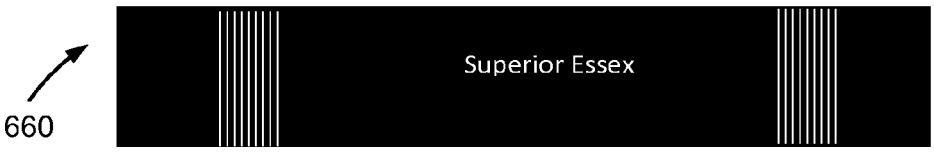
Figure 6N:
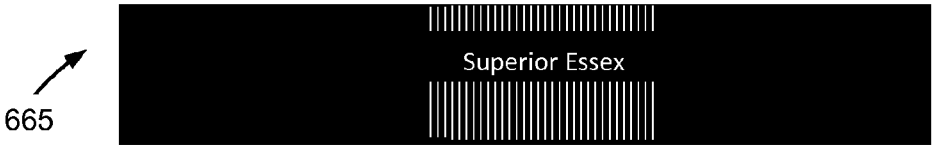

FIGS. 6A-6N illustrate example microcut configurations that may be incorporated into shielding elements as desired in various embodiments of the disclosure. A shielding element, such as the shield 120 illustrated in FIG. 1, may have a microcut and/or electrically conductive material configuration similar to at least one of the example configurations illustrated in FIGS. 6A-6N. With reference to FIG. 6A, a top level (or bottom level) view of a first example shielding element 600 is illustrated. The shielding element 600 may extend in a longitudinal direction, and a plurality of relatively closely spaced microcuts 602 may be formed across a widthwise direction (e.g., transverse to the longitudinal direction) of the shielding element 600. As shown, microcuts 602 may be continuously formed along the shielding element 600 with an approximately equal space (and associated patch of electrically conductive material) respectively remaining between each adjacent microcut. Additionally, in certain embodiments, each microcut may extend approximately from one edge of the shielding element to an opposing edge of the shielding element 600. Alternatively, one or more of the microcuts may extend partially across a widthwise direction of the shielding element 600.

Turning next to FIG. 6B, a shielding element 605 is illustrated in which sections or segments 607A, 607B of microcuts are formed at spaced intervals along a longitudinal length of the shielding element 605. The sections 607A, 607B of microcuts may delineate any number of rectangular patches of electrically conductive material. As desired in various embodiments, the rectangular patches of electrically conductive material may include any desired lengths. Additionally, the sections of microcuts may include any desired lengths. In certain embodiments, the patches and/or microcut sections may be formed in accordance with a repeating pattern having a definite step or period.

FIG. 6C illustrates a shielding element 610 in which microcuts are formed at an angle across the shielding element 610. In various embodiments, the angled microcuts may be continuously formed along a longitudinal length of the shielding element 610 or formed in a plurality of sections or segments, such as a repeating pattern of microcut sections or randomly spaced microcut sections. As desired, microcuts may be formed at any desired angle relative to an edge of the shielding element 610, such as a 15 degree angle, a 30 degree angle, a 45 degree angle, a 60 degree angle, or any angle included in a range between any two of the above values. Additionally, any combination of angles may be utilized with various microcuts and/or microcut sections within a given shielding element 610. Further, although angled sections of microcuts (i.e., sections in which the overall section dimensions are angled relative to an edge of the shielding element 610) are illustrated in FIG. 6C, other types of microcut sections may include angled microcuts. For example, the rectangular section of microcuts illustrated in FIG. 6B may include microcuts that are formed at an angle relative to an edge of the shielding element 605. In other words, although a microcut section has an overall rectangular shape, at least a portion of the microcuts may be formed at any desired angle(s).

FIGS. 6D and 6E illustrate shielding elements 615, 620 that include sections of microcuts in which the sections have nonrectangular dimensions. Turning first to FIG. 6D, microcut sections may be formed that each have the shape of a parallelogram. In other words, the sections may each be formed at an angle (e.g., an acute angle with respect to a width dimension) along the shielding element. Additionally, the patches of electrically conductive material between the microcut sections may each have an approximately parallelogram shape. The microcut sections may be formed at any desired angle, such as such as an angle less than 12 degrees, a 15 degree angle, a 30 degree angle, a 35 degree angle, a 45 degree angle, a 60 degree angle, or any angle included in a range between any two of the above values. Additionally, a wide variety of different configurations of microcuts may be formed within each section, and each microcut may be formed at any desired angle relative to a longitudinal edge of the shielding element 615. As shown in FIG. 6D, microcuts that are transverse to a longitudinal axis of the shielding element 615 may be formed in each section. In other embodiments, microcuts that are angled with respect to an edge of the shielding element 615 and/or microcuts that are parallel to a longitudinal axis of the shielding element 615 may be formed.

Turning next to FIG. 6E, a shielding element 620 is illustrated in which microcut sections have approximately trapezoidal shapes. In certain embodiments, the orientation of adjacent trapezoidal sections may alternate. Additionally, a wide variety of different configurations of microcuts may be formed within each section. As shown in FIG. 6E, microcuts that are parallel to a longitudinal axis of the shielding element 620 may be formed in each section. In other embodiments, microcuts that are angled with respect to an edge of the shielding element 620 and/or microcuts that are transverse to a longitudinal axis of the shielding element 620 may be formed.

FIG. 6F illustrates an example shielding element 625 in which one or more microcut sections may include dashed or broken line microcuts. These dashed or broken lines may be formed at any desired angle relative to the longitudinal axis of the shielding element, such as the illustrated approximately 90 degree angle. Additionally, within any given line of microcuts, the individual cuts or dashes may have any desired length. Any desired spacing may also be utilized in a microcut line between adjacent cuts or dashes. Further, the lengths of individual cuts and/or spacing between cuts may be varied as desired. A microcut section may also include a plurality of dashed lines in which two or more of the dashed lines are dimensionally different from one another. In other embodiments, a microcut section may include a combination of continuous and dashed lines of microcuts.

FIG. 6G illustrates an example shielding element 630 in which one or more microcut sections include a square or rectangular microcut pattern. In FIG. 6G, a series of vertical and horizontal microcuts are formed in a microcut section in order to create a square pattern. As desired, a wide variety of suitable spacing may be utilized between the microcuts. Following the formation of the microcuts, squares or rectangles of electrically conductive material may remain. FIG. 6H illustrates an example shielding element 635 in which one or more microcut sections include an inverse square or inverse rectangular microcut pattern. In other words, microcuts are formed in order to selectively remove squares of electrically conductive material. As a result, a square or rectangular pattern of horizontal and vertical lines of electrically conductive material may remain.

FIG. 6I illustrates an example shielding element 640 in which one or more microcut sections include a diamond-shaped microcut pattern. Similarly, FIG. 6J illustrates an example shielding element 645 in which one or more microcut sections include an inverse diamond-shaped microcut pattern. A diamond-shaped pattern may be formed by varying the angles of microcuts formed within a microcut section. Additionally, much like the rectangular patterns, a wide variety of different sizes of microcuts and/or spacing between microcuts may be utilized. FIG. 6K illustrates an example shielding element 650 in which one or more microcut sections include a checkerboard pattern. A checkerboard pattern may include alternating squares or rectangles of microcuts and electrically conductive material. A wide variety of other patterns may be utilized as desired, such as patterns that include wavy or curved lines, patterns that include other shapes (e.g., triangles, octagons, etc.), and/or patterns that include any desired combination of elements.

Additionally, in certain embodiments, microcuts may be utilized to form or otherwise define alphanumeric characters, text, graphics, and/or logos. FIG. 6L illustrates an example shielding element 655 in which microcuts are utilized to inscribe text into electrically conductive material, such as an identifier of a manufacturer. FIG. 6M illustrates an example shielding element 660 in which microcuts are utilized to form text in between two sections of microcuts (e.g., parallel microcuts in a width dimension, etc.). FIG. 6N illustrates an example shielding element 665 in which microcuts are utilized to form text within a microcut section. Inverse text and/or logos may be formed in a similar manner. In other embodiments, microcut sections may be formed to display graphics and/or logos.

In yet other embodiments, microcut sections may be formed to include one or more curved lines. For example, microcut sections may include one or more sinusoidal lines or wave lines. As another example, microcut sections may include one or more arcs, semicircles, circles, ovals, or other curved lines. In other embodiments, microcut sections may include a combination of curved lines and straight lines. Indeed, the ability to form microcuts in electrically conductive material allows virtually unlimited combinations of patterns and designs. Additionally, in certain embodiments, microcuts may be formed in a desired pattern in order to provide shielding at a certain frequency or over a desired range of frequencies. As desired, a microcut pattern may also be designed to result in a desired spike or peak in return loss. For example, a microcut pattern may be formed such that a standing wave of electrical or electromagnetic interaction along the shielding element produces a spike in return loss. In certain embodiments, the microcuts can be sized and/or spaced so that the return loss spike is located within the cable's operating frequency range, but is suppressed to avoid compromising a return loss specification.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

at least one twisted pair of individually insulated conductors;

a shielding element configured to provide electromagnetic shielding for the at least one twisted pair, the shielding element comprising:

a dielectric material;

electrically conductive material formed on the dielectric material, the electrically conductive material defining a plurality of patches with each patch having a longitudinal length between approximately 0.5 meters and approximately 5.0 meters, wherein a respective separation region is positioned between adjacent patches and at least one separation region has a total width along the longitudinal length between approximately 5.0 mm and approximately 100 mm and comprises:

a plurality of microcuts formed in the electrically conductive material, each of the plurality of microcuts having a width equal to or less than approximately 0.25 mm with the electrically conductive material positioned between adjacent microcuts having a width of less than approximately 25 mm such that the electrically conductive material between the plurality of microcuts will fuse together if an electrical current is applied to the shielding element; and a jacket formed around the at least one twisted pair and the shielding element.

2. The cable of claim 1, wherein each patch of electrically conductive material has a longitudinal length between approximately 1.0 meter and approximately 3.0 meters.

3. The cable of claim 1, wherein the shielding element comprises one of (i) a shield layer formed around the at least one twisted pair, or (ii) a separator formed between the at least twisted pair and another twisted pair.

4. The cable of claim 1, wherein the plurality of microcuts are formed through the electrically conductive material.

5. The cable of claim 1, wherein the plurality of microcuts are formed partially through the electrically conductive material.

6. The cable of claim 1, wherein the at least one separation region has a total width along the longitudinal length of less than approximately 51 mm.

7. The cable of claim 1, wherein the separation regions are spaced apart along a longitudinal length of the shielding element in accordance with a pattern.

8. The cable of claim 1, wherein at least one of the plurality of microcuts is formed across a widthwise dimension of the shielding element approximately transverse to a longitudinal direction of the cable.

9. The cable of claim 1, wherein at least one of the plurality of microcuts is formed at an angle with respect to an edge of the shielding element.

10. The cable of claim 1, wherein the plurality of microcuts are formed in one of (i) a parallel line pattern, (ii) a dashed parallel line pattern, (iii) a rectangular pattern, (iv) an inverse rectangular pattern, (v) a diamond pattern, (vi) an inverse diamond pattern, (vii) a checkerboard pattern, or (viii) a curved line pattern.

11. The cable of claim 1, wherein the plurality of microcuts comprise microcuts that form one of (i) an alphanumeric character, (ii) a logo, or (iii) a graphical design.

12. The cable of claim 1, wherein the plurality of microcuts are formed by one or more lasers.

13. The cable of claim 1, wherein the plurality of microcuts are formed in an inline process during assembly of the cable.

14. A cable comprising:

a jacket defining a cable core;

a plurality of individually insulated conductors positioned within the cable core; and a shield layer formed around at least one of the plurality of conductors, the shield layer comprising:

a plurality of electrically conductive patches formed on a substrate, each patch having a length of at least approximately 0.30 meters, wherein at least two of the patches are separated by a series of microcuts positioned in close proximity to one another, the series of microcuts having a total width of less than approximately 51 mm and each of the microcuts having a width equal to or less than approximately 0.25 mm.

15. The cable of claim 14, wherein the electrically conductive material positioned between the microcuts will fuse together if an electrical current is applied to the shield layer.

16. The cable of claim 14, wherein a width of electrically conductive material between adjacent microcuts is less than approximately 25 mm.

17. The cable of claim 14, wherein each of the plurality of microcuts is formed either (i) through the electrically conductive material or (ii) partially through the electrically conductive material.

18. The cable of claim 14, wherein the series of microcuts is formed in one of (i) a parallel line pattern, (ii) a dashed parallel line pattern, (iii) a rectangular pattern, (iv) an inverse rectangular pattern, (v) a diamond pattern, (vi) an inverse diamond pattern, (vii) a checkerboard pattern, or (viii) a curved line pattern.

* * * * *